US009650916B2

(12) United States Patent
Barton et al.

(10) Patent No.: US 9,650,916 B2
(45) Date of Patent: May 16, 2017

(54) TURBOMACHINE COOLING SYSTEMS

(71) Applicant: HONEYWELL INTERNATIONAL INC., Morristown, NJ (US)

(72) Inventors: Michael Todd Barton, Phoenix, AZ (US); John Schugardt, Chandler, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 423 days.

(21) Appl. No.: 14/248,579

(22) Filed: Apr. 9, 2014

(65) Prior Publication Data

US 2015/0292355 A1 Oct. 15, 2015

(51) Int. Cl.

| | |
|---|---|
| ***F01D 25/14*** | (2006.01) |
| ***F04D 29/42*** | (2006.01) |
| ***F04D 29/16*** | (2006.01) |
| ***F04D 29/68*** | (2006.01) |

(52) U.S. Cl.

CPC ..... *F01D 25/14* (2013.01); *F04D 29/162* (2013.01); *F04D 29/4206* (2013.01); *F04D 29/685* (2013.01)

(58) Field of Classification Search

CPC .... F01D 25/14; F04D 29/4206; F04D 29/162; F04D 29/685

USPC .... 415/1.11, 58.2, 58.4, 116, 184, 205, 206, 415/914, 1, 11

See application file for complete search history.

(56) References Cited

U.S. PATENT DOCUMENTS

| | | | | |
|---|---|---|---|---|
| 2,970,750 | A * | 2/1961 | Swearingen | F04D 17/164 277/352 |
| 4,248,566 | A | 2/1981 | Chapman et al. | |
| 4,255,080 | A | 3/1981 | Wilson et al. | |
| 5,619,850 | A | 4/1997 | Palmer et al. | |
| 5,839,397 | A * | 11/1998 | Funabashi | B60K 11/04 123/41.01 |
| 5,857,833 | A | 1/1999 | Dev | |
| 6,447,241 | B2 | 9/2002 | Nakao | |
| 7,147,426 | B2 | 12/2006 | Leblanc et al. | |
| 7,407,364 | B2 | 8/2008 | Arnold et al. | |
| 7,775,759 | B2 | 8/2010 | Sirakov et al. | |
| 7,946,801 | B2 * | 5/2011 | Shapiro | F01D 5/08 415/1 |
| 8,061,974 | B2 | 11/2011 | Gu et al. | |
| 8,092,145 | B2 | 1/2012 | Martel et al. | |

(Continued)

FOREIGN PATENT DOCUMENTS

| | | |
|---|---|---|
| EP | 0526965 A2 | 2/1993 |
| EP | 2669526 A1 | 12/2013 |

(Continued)

OTHER PUBLICATIONS

Extended EP Search Report for EP 15160825.4-1610 dated Jul. 8, 2015.

*Primary Examiner* — Hoang Nguyen

(74) *Attorney, Agent, or Firm* — Lorenz & Kopf, LLP

(57) ABSTRACT

Embodiments of a turbomachine, having a longitudinal axis and a flowpath are provided. The turbomachine includes an impeller circumferentially disposed around the longitudinal axis, and an impeller shroud that surrounds a portion of the impeller. At least one opening formed through the impeller shroud surface provides fluid communication between the flowpath and a dead-headed plenum.

15 Claims, 6 Drawing Sheets

(56) References Cited

U.S. PATENT DOCUMENTS

| | | | | |
|---|---|---|---|---|
| 8,210,794 | B2 | 7/2012 | Nolcheff et al. | |
| 8,221,070 | B2 | 7/2012 | Baryshnikov | |
| 8,287,233 | B2 | 10/2012 | Chen | |
| 8,490,408 | B2 | 7/2013 | Nichols et al. | |
| 2010/0215485 | A1 | 8/2010 | Childe et al. | |
| 2012/0141261 | A1 | 6/2012 | Giovannetti et al. | |
| 2013/0051974 | A1* | 2/2013 | Poon | F04D 29/4206 415/1 |
| 2013/0160452 | A1 | 6/2013 | Bourgois et al. | |

FOREIGN PATENT DOCUMENTS

| | | | |
|---|---|---|---|
| GB | 705387 | | 3/1954 |
| JP | 2009156122 | A | 7/2009 |
| WO | 2005068842 | A1 | 7/2005 |
| WO | 2013111780 | A1 | 8/2013 |

* cited by examiner

TURBOMACHINE COOLING SYSTEMS

TECHNICAL FIELD

The present invention relates generally to turbomachines and, more particularly, to auxiliary power units and gas turbine engines and methods for cooling components thereof.

BACKGROUND

Turbomachines include gas turbine engines such as auxiliary power units, propulsive gas turbine engines deployed onboard aircraft and other vehicles, turboshaft engines utilized for industrial power generation, and non-gas turbine engines, such as turbochargers. Generally, a turbomachine includes a compressor section, a combustion section, and a turbine section. During operation, air flows through the stages of the turbomachine as follows. The compressor section draws ambient air into the inlet of the turbomachine, compresses the inlet air with one or more compressors, and supplies the compressed inlet air to the combustion section. The combustion section also receives fuel via a fuel injection assembly, mixes the fuel with the compressed air, ignites the mixture, and supplies the high energy hot combustion gases to the turbine section. The turbine section drives one or more turbines, including a shaft that may be used to drive the compressor and other components. The flowpath is defined by air moving through the stages in the turbomachine, inclusive of the inlet air, compressed inlet air and hot combustion gases.

Turbomachines often employ centrifugal compressors as a means to compress air prior to delivery into the engine's combustion chamber. The rotating element of the centrifugal compressor, commonly referred to as an impeller, is typically surrounded by a generally conical or bell-shaped shroud, which helps guide air in the flowpath from the forward section (commonly referred to as the "inducer" section) to the aft section of the impeller (commonly referred to as the "exducer" section).

Some conventional impeller designs, commonly referred to as ported shroud impellers, boost performance by extracting air from the flowpath through various methods. Air flow may be extracted in either of two directions, depending upon the operational conditions of the impeller. Conventional ported shroud impeller designs then either reintroduce the extracted air into the flowpath (typically at the impeller inlet) or dump the extracted air overboard (with an associated penalty to the engine cycle). Specifically, when the impeller is operating near the choke side of its operating characteristic, the conventional ported shroud impeller "inflows" or reintroduces extracted air into the flow path (that is, draws air into the impeller through at least one opening) to increase the choke side range of the impeller operating characteristic; and, when the impeller is operating near the stall side of its operating characteristic, the conventional impeller shroud outflows (that is, bleeds or extracts air from the impeller through at least one opening) to increase the stall side range of the impeller operating characteristic. While conventional ported shroud impellers of the type described above can increase impeller performance within limits, further improvements in efficiency are desirable.

Accordingly, an improvement in efficiency that simplifies design complexity, parts count, and weight, is desirable. The desirable improvement in impeller efficiency is not reliant upon an extraction of air from the flowpath and is achieved without a corresponding decrease in flow capacity, pressure ratio, or surge margin. Other desirable features and characteristics of the present invention will become apparent from the subsequent Detailed Description and the appended Claims, taken in conjunction with the accompanying Drawings and the foregoing Background.

BRIEF SUMMARY

This summary is provided to introduce a selection of concepts in a simplified form that are further described below in the detailed description section. This summary is not intended to identify key features or essential features of the claimed subject matter, nor is it intended to be used as an aid in determining the scope of the claimed subject matter.

A first exemplary embodiment of a turbomachine having a longitudinal axis and a flowpath is provided. The turbomachine includes an impeller circumferentially disposed around the longitudinal axis. An impeller shroud is coupled to and extends around a portion of the impeller. The impeller shroud includes a surface having an inlet edge and an outlet edge. A first opening formed through the impeller shroud provides fluid communication between the flowpath and the dead-headed plenum.

Another exemplary embodiment of a turbomachine having a longitudinal axis and a flowpath is provided. The turbomachine includes an impeller circumferentially disposed around the longitudinal axis. An impeller shroud is coupled to and extends around a portion of the impeller. The impeller shroud includes a surface having an inlet edge and an outlet edge. A plurality of openings is formed through the impeller shroud, providing fluid communication between the flowpath and the dead-headed plenum.

In a further embodiment, a method for cooling a turbomachine having a flowpath and a dead-headed plenum is provided. The method includes providing fluid communication between the flowpath and the dead-headed plenum.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over any other implementations. Furthermore, there is no intention to be bound by any expressed or implied theory presented in the preceding Technical Field, Background, Brief Summary or the following Detailed Description.

The following descriptions may refer to elements or nodes or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the drawings may depict one exemplary arrangement of elements, additional intervening elements, devices, features, or components may be present in an embodiment of the depicted subject matter. In addition, certain terminology may also be used in the following description for the purpose of reference only, and thus are not intended to be limiting.

Figure 1:
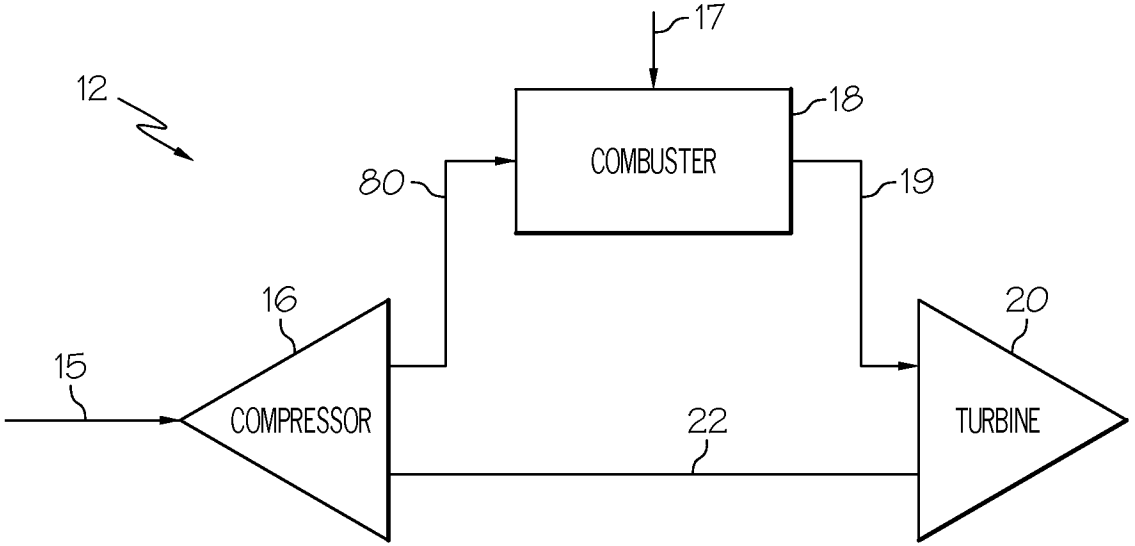
FIG. 1 is a simplified schematic illustration of a turbomachine.

FIG. 1 is a simplified schematic illustration of a turbomachine 12 including a compressor module 16, a combustor module 18, and a turbine module 20. The compressor module 16, combustor module 18, and turbine module 20 are in air flow communication. Compressor module 16 and turbine module 20 are coupled by a shaft 22. Shaft 22 rotates about an axis of symmetry, which is the centerline of the shaft 22. The shaft 22 forms the longitudinal axis of the turbomachine, also referred to as the engine centerline. In operation, air flows from the inlet of the turbomachine, as inlet air 15, through the compressor module 16, where it is compressed. Compressed air 80 is then provided to combustor module 18 where it is mixed with fuel 17 provided by fuel nozzles (not shown). The fuel/air mixture is then ignited within the combustor module 18 to produce hot combustion gases 19 that drive turbine module 20. The flowpath is defined by air flow moving through the stages in the turbomachine, inclusive of the inlet air 15, compressed air 80 and hot combustion gases 19.

As introduced above, centrifugal compressors are often utilized within the compressor module of a turbomachine to compress air flow prior to delivery into the engine's combustion chamber. It is to be understood that in the exemplary embodiments herein, only one compressor and one turbine are shown for ease of illustration, but multiple compressors and turbines may be present in various stages of a turbomachine.

Figure 2:
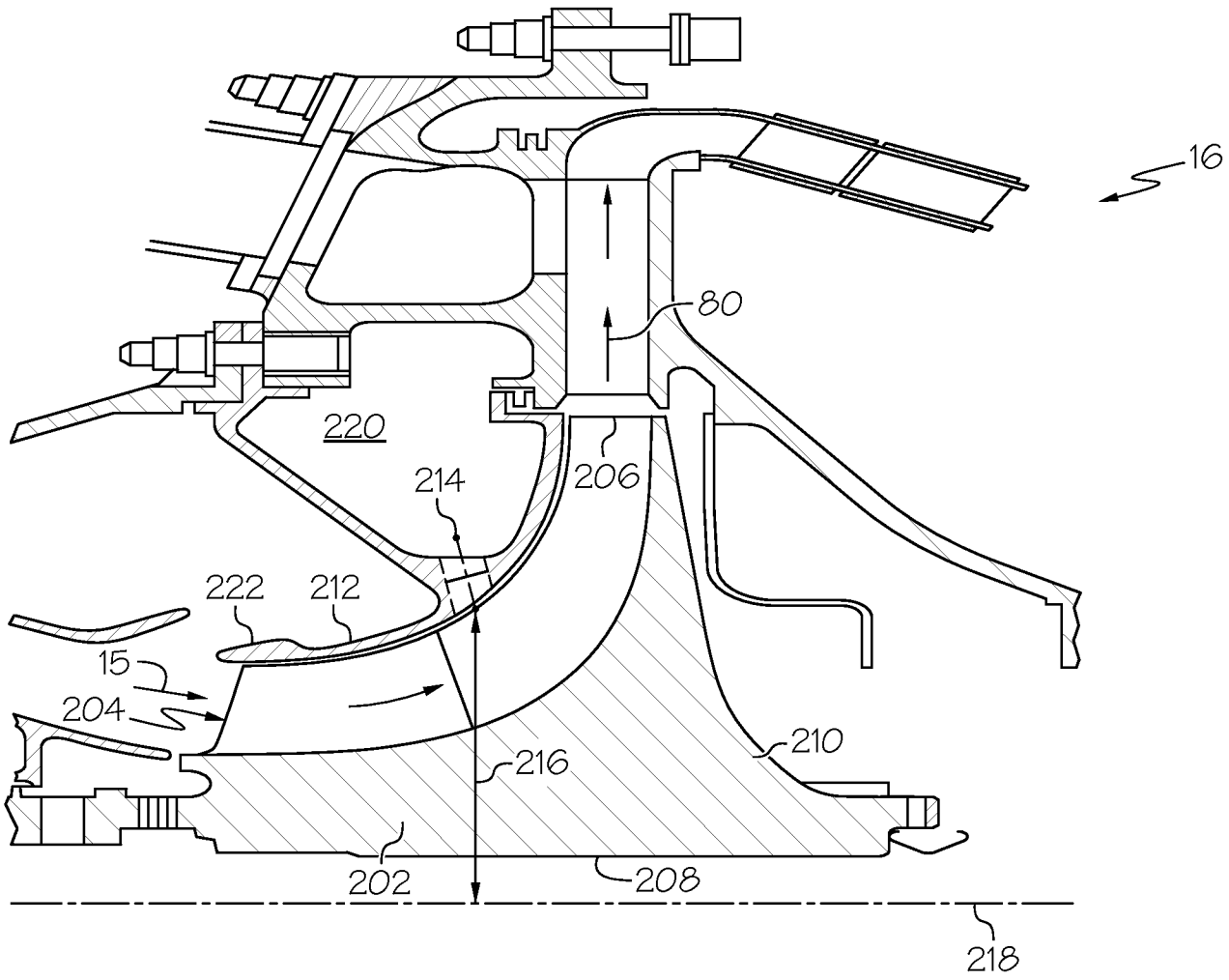
FIG. 2 is a side cross-sectional schematic illustration of a portion of the turbomachine.

FIG. 2 is a side cross-sectional schematic illustration of a portion of an exemplary compressor module 16 of the type used in turbomachine 12. Compressor module 16 includes an impeller 202. The impeller 202 includes an impeller inlet 204 (defined in part by an inlet edge of the impeller shroud 222), an impeller exit 206 (defined in part by an outlet edge of the impeller shroud), an impeller hub 208, and a rotating impeller body 210 extending therebetween. As part of the flowpath, inlet air 15 flows from impeller inlet 204 to impeller exit 206. As illustrated, the impeller 202 also includes a non-rotating conventional impeller shroud 212 that extends around, or surrounds, a portion of the impeller body 210, as hereinafter described. The impeller body 210 and impeller shroud 212 extend radially outward from the impeller inlet 204 to the impeller exit 206. Impeller hub 208 is coupled circumferentially to a rotor shaft (not shown).

In accordance with an exemplary embodiment, at least one opening 214 may be disposed in the impeller shroud 212 between the impeller inlet 204 and impeller exit 206; the opening 214 providing fluid communication between the impeller portion of the flowpath and the plenum 220. The opening 214 is circumferentially aligned at a radial distance 216, drawn perpendicularly from the engine centerline 218. The opening 214 in the impeller shroud 212 is located between the impeller inlet 204 and the impeller exit 206, and provides fluid communication between the plenum 220 and the impeller flowpath. The shroud 212 may be about 0.075 inches thick to about 0.400 inches thick, but other thicknesses for the impeller shroud 212 may be used depending on operating conditions and performance requirements of the turbine engines in addition to geometry and manufacturing constraints, as known to one skilled in the art.

Opening 214 is substantially circular in the exemplary embodiments described in FIGS. 3 thru 6; having a diameter of about 0.010 inch to about 0.300 inch; however in some embodiments, opening 214 may have an oval shape, may be slot-shaped defined by a width of about 0.1 inch to about 0.6 inch, or any other shape that permits fluid communication with the dead-headed plenum. In some embodiments, openings have the same dimensions, and/or be equally spaced, but this is not a requirement The openings in the impeller shroud provide fluid communication between the impeller flowpath and plenum 220. Plenum 220 is otherwise a closed cavity, i.e., there are no other openings into plenum 220 to support any other active or passive ingress or egress of air; therefore, plenum 220 is herein referred to as a dead-headed plenum. As a dead-headed plenum, plenum 220 does not communicate with an outside environment, thus reducing the likelihood of the introduction of dirt or other foreign debris into the impeller flowpath. Plenum 220 may take the form of a variety of shapes and volumes, while continuing to be a dead-headed plenum as described herein, and while continuing to be in fluid communication with the impeller flowpath.

The embodiments described herein provide a gain in compressor efficiency without extracting air (conventionally referred to as bleed flow extraction) from the cavity, and there is no loss in surge margin utilizing this technique. The gain is recognized over a variety of cavity shapes and cavity volumes.

Figure 3:
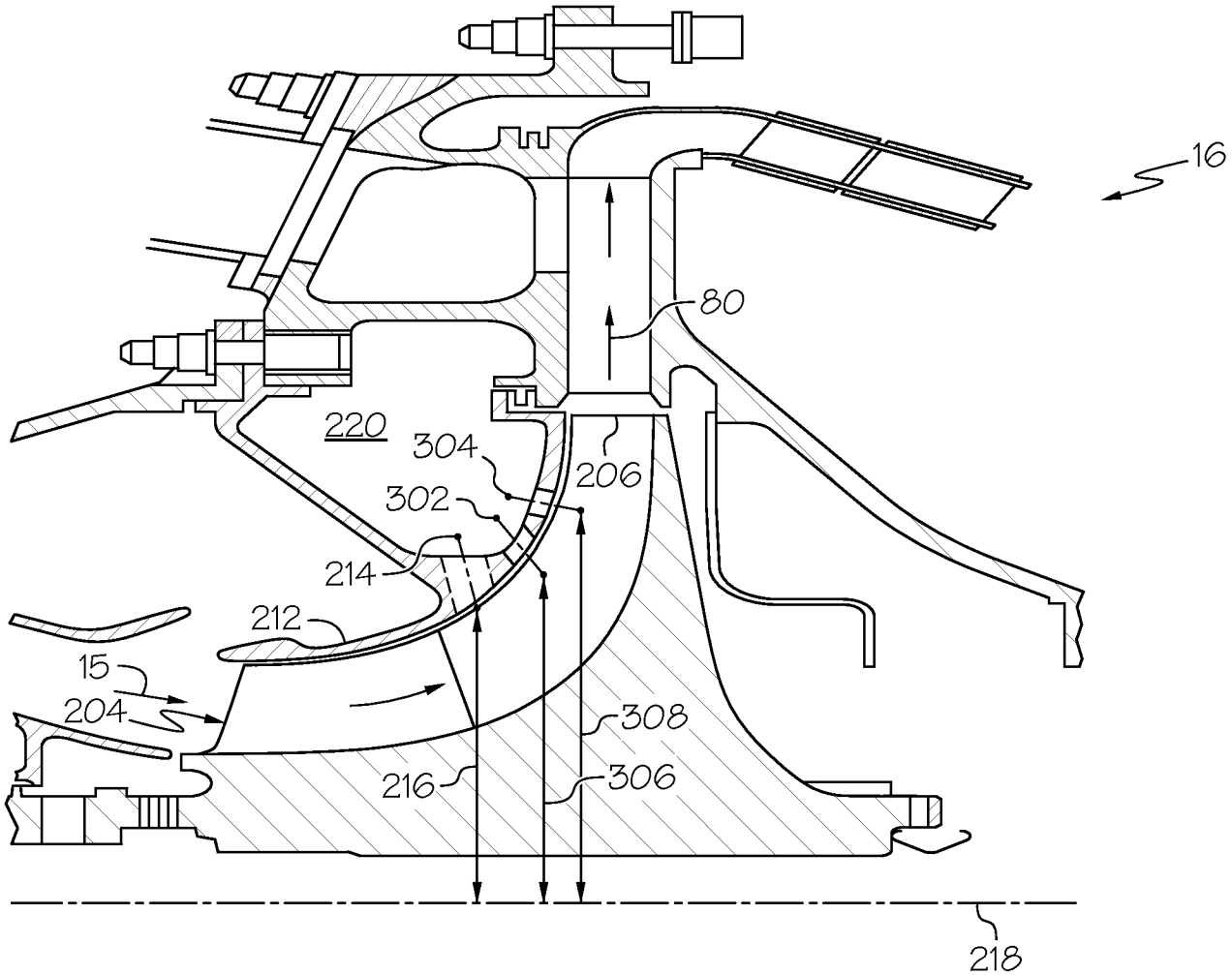
FIG. 3 is the cross-sectional schematic illustration of FIG. 2 showing exemplary locations for openings in the impeller shroud in accordance with an exemplary embodiment.

FIG. 3 is the cross-sectional schematic illustration of FIG. 2 showing exemplary locations for openings in the impeller shroud 212 in accordance with an exemplary embodiment. FIG. 3 depicts opening 214 circumferentially aligned at radial distance 216, opening 302 circumferentially aligned at radial distance 306, and opening 304 circumferentially aligned at radial distance 308. Plenum 220 is depicted as a dead-headed cavity except for the openings through the impeller shroud 212. Radial distance is measured perpendicular to the longitudinal axis of the turbomachine, or the engine centerline 218. The openings in the impeller shroud can be located anywhere along the shroud between impeller inlet 204 and impeller exit 206.

Figure 4:
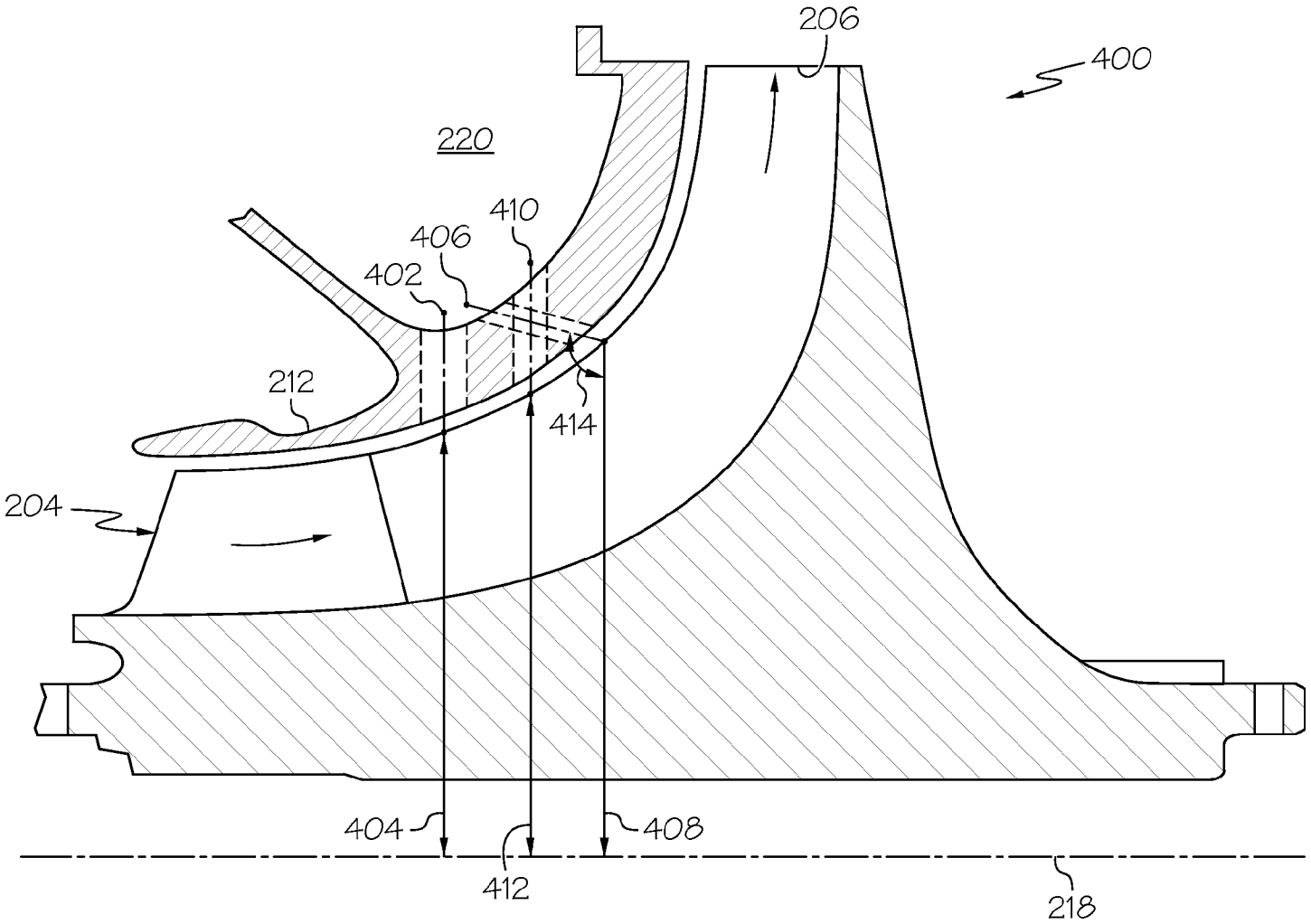
FIG. 4 is an enlarged view of FIG. 3 showing exemplary locations for openings according to the exemplary embodiment.

FIG. 4 is an enlarged view of FIG. 3 showing exemplary locations for openings according to the exemplary embodiment. FIG. 4 depicts impeller shroud 212, impeller inlet 204, impeller exit 206, and plenum 220. Also shown are opening 402, at radial distance 404, opening 406 at radial distance 408, and opening 410 at radial distance 412. Radial distance is measured from the longitudinal axis of the turbomachine, or the engine centerline 218. Depending upon the embodiment, the centerline axis of an opening may or may not be perpendicular to the engine centerline. For example, opening 406 is depicted with a centerline axis having an angle 414 from the perpendicular line representing the radial distance 408.

Figure 5:
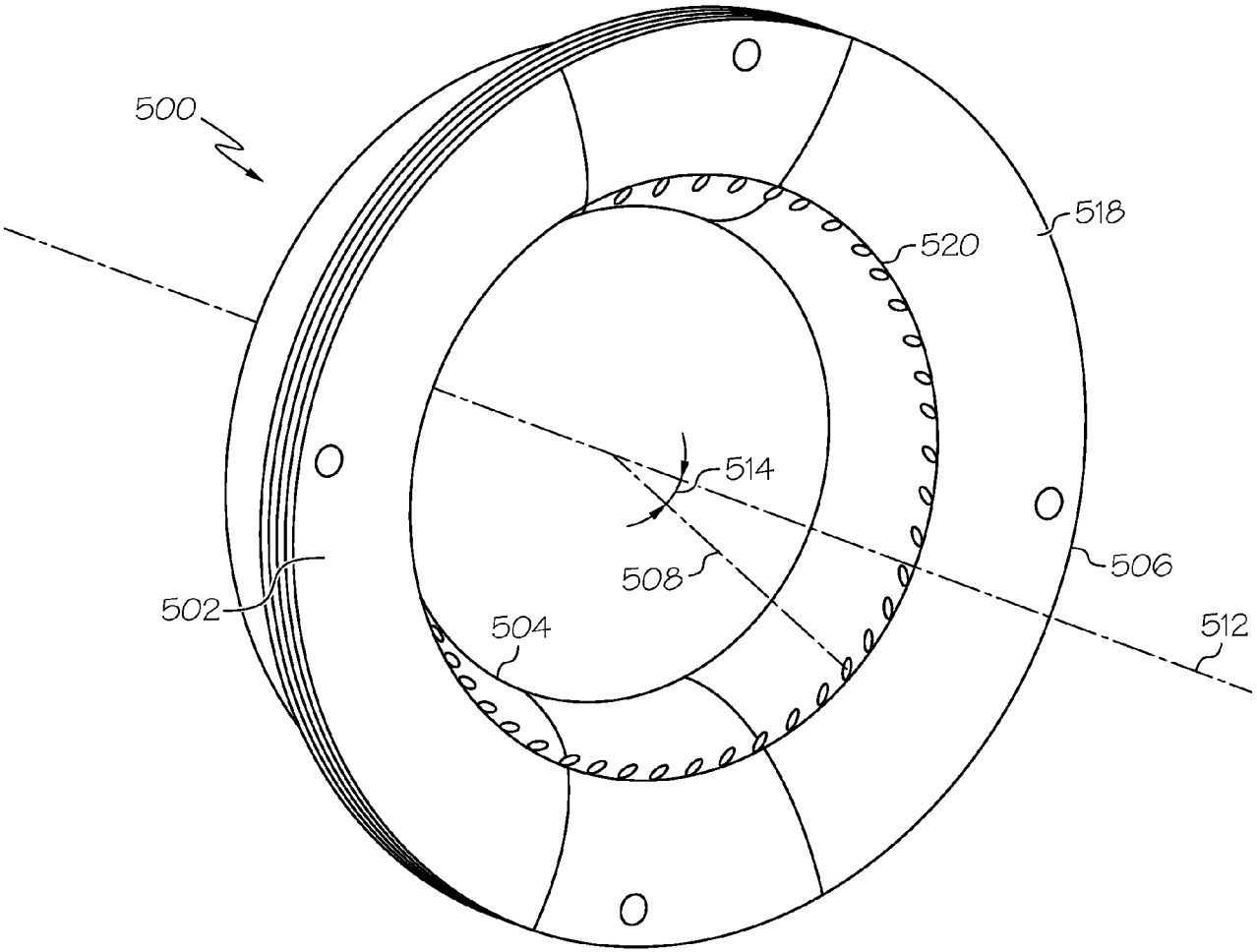
FIG. 5 is three-dimensional rendering of an impeller shroud according to an exemplary embodiment.

FIG. 5 is a three-dimensional rendering of an impeller shroud 500 according to an exemplary embodiment. A plurality of openings 518 are depicted as having substantially the same dimensions, being substantially medially located, and being substantially circumferentially aligned on the surface of the impeller shroud 502. As described hereinabove, the openings are located at a predetermined radial distance (e.g., radial distance 508) from the longitudinal axis or engine centerline 512. In FIG. 5, radial distance 508 is depicted at angle 514 from engine centerline 512. In the exemplary embodiment, the angle 514 is ninety degrees and radial distance lines are perpendicular to the longitudinal axis, but in other embodiments the angle may vary.

In an exemplary embodiment, openings are disposed within the region defined by the inlet edge of the impeller shroud 504 and a substantially medial line 520 circumferentially around impeller shroud 502 referred to herein as the "knee". The knee may be arrived at by incrementally increasing the radial distance described hereinabove, concurrent with moving along the longitudinal axis from the inlet edge of the impeller shroud (co-aligned with the impeller inlet 204) toward the impeller exit 206. The knee is substantially midpoint on the impeller shroud and may represent a point of inflection on the impeller shroud surface. The radial distance used for the placement of the openings varies in different embodiments of the turbomachine, since the location of the openings for ideal performance may vary from one compressor design to the next. The openings in the impeller shroud can be located anywhere along the shroud between impeller inlet 204 and impeller exit 622. In some embodiments, the radial distance varies from one opening to another, resulting in openings that are not circumferentially aligned, as is depicted in FIG. 6.

Figure 6:
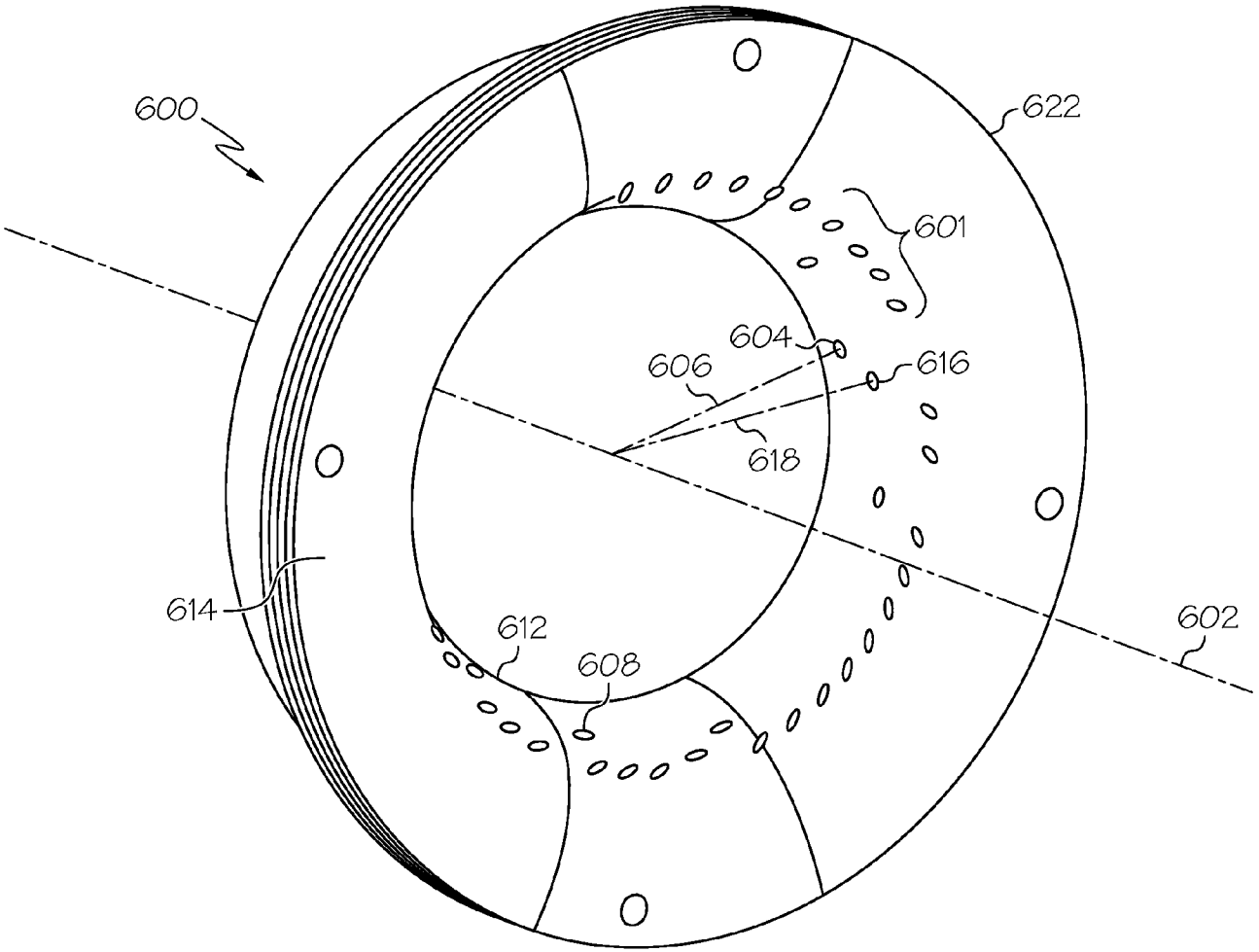
FIG. 6 is three-dimensional rendering of an impeller shroud according to an exemplary embodiment.

FIG. 6 is three-dimensional rendering of an impeller shroud 600 according to a further exemplary embodiment. A plurality of openings 601 are depicted on the surface of the impeller shroud 614. As described hereinabove, the openings are located at a radial distance from the engine centerline 602. In FIG. 6, openings 601 are depicted at different radial distances from the longitudinal axis or engine centerline 602, but still located between the inlet edge of the impeller shroud 612 and the edge of the impeller exit 622. For example, opening 604 is located at radial distance 606, opening 620 is located at radial distance 618; opening 608 is also shown between the inlet edge of the impeller shroud and the edge of the impeller exit 622.

Once the centerline orientation of the first opening in the impeller shroud has been determined, the other openings in the impeller shroud may be generated by rotating the impeller shroud to define an opening pattern. The other openings may have substantially the same radial distance, and substantially the same centerline axis angle as the first opening. Alternatively, the centerline axis of each of openings in the impeller shroud may be determined independently using the multiple rotation angles. In some embodiments the distance between adjacent pairs of openings is substantially equal, however this is not required.

The foregoing has thus provided embodiments of a turbomachine and, specifically, an auxiliary power unit including an impeller shroud with openings communicating with a dead-headed plenum improving efficiency. The above-described impeller shroud system can be implemented in a relatively low cost, low part count and straightforward manner and provides reliable, passive operation. Advantageously, embodiments of the above-described impeller shroud system can also be installed as a retrofit into existing turbomachine, such as service-deployed auxiliary power unit. While primarily described in the context of a particular type of turbomachine, namely, an auxiliary power unit, it is emphasized that embodiments of the impeller shroud system can be utilized in conjunction with other types of gas turbine engines and turbomachines including turbochargers.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as setforth in the appended Claims.

What is claimed is:

1. A turbomachine having a longitudinal axis and a flowpath, comprising:

an impeller circumferentially disposed around the longitudinal axis;

an impeller shroud comprising a surface having an inlet edge and an outlet edge, the impeller shroud coupled to and extending around a portion of the impeller;

a plurality of openings formed through the impeller shroud, wherein at least one of the openings comprises a centerline that is not perpendicular to the longitudinal axis; and a dead-headed plenum, wherein each of the plurality of openings provides fluid communication between the flowpath and the dead-headed plenum, and wherein there are no other openings in the dead-headed plenum.

2. The turbomachine of claim 1, wherein the first opening is circular with a diameter of from about 0.010 inches to about 0.300 inches.

3. The turbomachine of claim 1, wherein the impeller shroud surface defines a knee and the plurality of openings are disposed through the surface between the knee and the inlet edge of the impeller shroud.

4. The turbomachine of claim 3, wherein the plurality of openings are substantially circumferentially aligned between the inlet edge of the impeller shroud and the outlet edge of the impeller shroud.

5. The turbomachine of claim 3, wherein the distance between adjacent pairs of openings is substantially equal.

6. The turbomachine of claim 3, wherein the distance between adjacent pairs of openings is different.

7. The turbomachine of claim 1 wherein the impeller shroud has a thickness of about 0.075 inches thick to about 0.400 inches thick.

8. The turbomachine of claim 3, wherein one or more of the plurality of openings is slot-shaped, with a first dimension of about 0.1 inches and a second dimension of about 0.6 inches.

9. A turbomachine having a longitudinal axis and a flowpath, comprising:

an impeller circumferentially disposed around the longitudinal axis;

an impeller shroud comprising a surface having an inlet edge and an outlet edge, the impeller shroud coupled to and extending around a portion of the impeller, the impeller shroud surface defining a knee;

a plurality of openings formed through the impeller shroud, disposed (i) through the surface between the knee and the inlet edge, or (ii) through the surface and between the inlet edge of the impeller shroud and the outlet edge of the impeller shroud;

a dead-headed plenum, wherein the plurality of openings provides fluid communication between the flowpath and the dead-headed plenum, wherein at least one of the openings comprises a centerline that is not perpendicular to the longitudinal axis, and wherein there are no other openings in the dead-headed plenum.

10. The turbomachine of claim 9, wherein each of the plurality of openings are located at a predetermined first radial distance from the longitudinal axis.

11. The turbomachine of claim 9, wherein each of the plurality of openings are located at different radial distances from the longitudinal axis.

12. The turbomachine of claim 9, wherein, for the plurality of openings, the distance between adjacent pairs of openings is substantially equal.

13. The turbomachine of claim 9, wherein, for the plurality of openings, the distance between adjacent pairs of openings is different.

14. The turbomachine of claim 9, wherein each of the plurality of openings are circular with a diameter of from about 0.010 inches to about 0.400 inches.

15. The turbomachine of claim 9, wherein one or more of the plurality of openings is slot-shaped, with a first dimension of about 0.1 inches and a second dimension of about 0.6 inches.

* * * * *